US008448990B2

(12) United States Patent
Korich

(10) Patent No.: US 8,448,990 B2
(45) Date of Patent: May 28, 2013

(54) APPARATUS AND METHOD FOR RAMPING AND/OR CANTING A SKIER

(75) Inventor: Chris Korich, Oakland, CA (US)

(73) Assignee: BioStance, LLC, Vail, CO (US)

( * ) Notice: Subject to any disclaimer, the term of this patent is extended or adjusted under 35 U.S.C. 154(b) by 0 days.

(21) Appl. No.: 13/296,612

(22) Filed: Nov. 15, 2011

(65) Prior Publication Data

US 2012/0061945 A1 Mar. 15, 2012

Related U.S. Application Data

(60) Continuation-in-part of application No. 13/012,458, filed on Jan. 24, 2011, now abandoned, which is a division of application No. 11/397,228, filed on Apr. 3, 2006, now Pat. No. 7,874,591.

(60) Provisional application No. 60/736,470, filed on Nov. 12, 2005.

(51) Int. Cl.
*A63C 9/00* (2006.01)
*A63C 11/00* (2006.01)

(52) U.S. Cl.
USPC ..... 280/809; 280/607; 280/636

(58) Field of Classification Search
USPC ..... 280/601, 607, 609, 11.3, 611, 617, 280/618, 620, 633, 636, 600, 602, 11.12, 280/11.14, 809
See application file for complete search history.

(56) References Cited

U.S. PATENT DOCUMENTS

| | | | | |
|---|---|---|---|---|
| 3,917,298 | A | 11/1975 | Haff | |
| 4,074,446 | A * | 2/1978 | Eisenberg | 36/117.5 |
| 4,078,322 | A * | 3/1978 | Dalebout | 36/117.4 |
| 4,137,654 | A * | 2/1979 | Hlavac | 36/117.5 |
| 4,937,955 | A * | 7/1990 | Bonaventure | 36/132 |
| 4,945,659 | A * | 8/1990 | De Marchi et al. | 36/117.5 |
| 5,026,086 | A * | 6/1991 | Guers et al. | 280/607 |
| 5,090,139 | A * | 2/1992 | Germann | 36/117.5 |
| 5,172,924 | A * | 12/1992 | Barci | 280/14.22 |
| 5,297,812 | A * | 3/1994 | Dogat et al. | 280/633 |
| 5,344,176 | A * | 9/1994 | Trimble | 280/602 |
| 5,503,900 | A * | 4/1996 | Fletcher | 428/160 |
| 5,615,901 | A | 4/1997 | Piotrowski | |
| 6,371,506 | B1 * | 4/2002 | DeNicola | 280/607 |
| 7,216,889 | B2 * | 5/2007 | Haupt | 280/618 |
| 7,344,149 | B2 * | 3/2008 | Leitner | 280/607 |
| 2009/0113763 | A1 * | 5/2009 | Narajowski et al. | 36/117.3 |

FOREIGN PATENT DOCUMENTS

| | | |
|---|---|---|
| DE | 3333318 A1 | 3/1985 |
| WO | 9818528 A1 | 5/1998 |

OTHER PUBLICATIONS

Witherell, Warren and Evrard, David, The Athletic Skier, copyright 1993, pp. 19-65, published by The Athletic Skier, Salt Lake City, Utah.

* cited by examiner

*Primary Examiner* — J. Allen Shriver, II
*Assistant Examiner* — Travis Coolman
(74) *Attorney, Agent, or Firm* — Charle E. Krueger

(57) ABSTRACT

An apparatus and method for balancing a skier comprises a Heel Mounting ("HMP") that locks on to the heel bearing surface of a ski binding. The HMP has a specified thickness to increase the height of the heel portion a ski boot over the toe portion when mounted in the ski binding. Thus, the HMP plate alters the ramp angle at which a boot supports a skier's foot and lower leg.

5 Claims, 9 Drawing Sheets

APPARATUS AND METHOD FOR RAMPING AND/OR CANTING A SKIER

RELATED APPLICATIONS

This application is a CIP of a non-provisional application filed Jan. 24, 2011 entitled SYSTEM AND METHOD FOR CANTING A SKIER, application Ser. No. 13/012,458, which is a divisional application of a non-provisional patent application filed Apr. 3, 2006 entitled SYSTEM AND METHOD FOR CANTING A SKIER, application Ser. No. 11/397,228 (now U.S. Pat. No. 7,874,591), which claims priority from a provisional application filed Nov. 12, 2005 entitled SYSTEM AND METHOD FOR CANTING A SKIER, application No. 60/736,470, all of which are hereby incorporated by reference for all purposes.

BACKGROUND OF THE INVENTION

To maximize skiing enjoyment, proficiency and safety, all skiers should have their equipment anatomically adjusted so that they are balanced when in a flat static condition. One of the most critical anatomical adjustments is referred to as "ramping" and another critical adjustment is referred to as "canting".

It is common to see skiers in the "back seat" when skiing. When a skier's weight is over the tails of his skis, it is difficult to turn and to control speed. Bumps tend to throw the skier further out of balance to the rear. Significant muscular effort is required to pull the body forward over the center of the skis or to pressure the front of the boots. The cause may be related to the fit of the ski boots, but even if the fit has been optimized for the skier's feet, the heel height versus the toe height when mounted in the ski/binding system is not likely to be optimal. Since by design most ski-binding systems have different heel versus toe heights, an optimal boot and binding combination is unlikely to be achieved even if the boot fit is originally correct. Although often referred to as ramp angle, the actual measurements are given in millimeters of difference with positive numbers meaning the heel is higher than the toe. Ramping alters the longitudinal tilt or "ramp angle" at which a boot supports a skier's foot and lower leg, relative to the longitudinal running surface or bottom plane of an attached ski, by raising the toe and/or the heel of the boot. Adjusting the heel and/or toe height to create an optimal ramp angle has a number of important advantages. In a static position such as on a cat track, a traverse, or the run-out at the end of a slope, the amount of muscular effort is minimized as is also the case when standing in a lift line or stopping on the hill. In a more dynamic situation, the skier adjusts his balance away from a neutral position but returns to it or passes through it frequently. With modern skis and skiing technique, the neutral or balanced position is one where equal weight is felt by the skier to be on the ball of the foot and the heel and the skis are not felt to be "tipped out".

The basic turns in skiing require either sliding a flat ski sideways or tilting the "outside" ski on its edge creating an arc for the ski to follow—or some combination of these two actions. If the ski is in a laterally tilted position when the skier is in his normal skiing position, skiing is very difficult and turning even more so. Excessive anatomical positions are required to flatten and "edge" the skis at the appropriate times. Canting alters the lateral tilt or "cant angle" at which a boot supports a skier's foot and lower leg, relative to the longitudinal running surface or bottom plane of an attached ski. Optimizing the cant angle improves skeletal alignment and allows the skier to tilt or "edge" the ski with the least amount of muscular effort.

In the 1993 book *The Athletic Skier*, authors Warren Witherell and David Evrard wrote that, "In our 1994 clinics with racers and ski instructors, we found that more than half were out of balance to the rear. A great many (especially the women) needed some heel lift inside the boot, where it should be integrated with an orthotic. (page 43, footnote added in 1994)" and "Only when properly canted can our bodies and skis work as efficiently as possible. By tilting or canting our boots, we can precisely control the geometry of our legs and establish an ideal position over our skis. Canting is the final step in the alignment process that makes efficient and balanced skiing possible for all skiers."

Recent changes in equipment design have only magnified the importance of optimizing a skier's cant angle and ramp angle. Some of these changes include the lateral stiffening of boot shells, the increased elevation or stand-height of binding systems, and the exaggerated side cut or shape of modern skis.

Unfortunately, most ski shops still do not offer canting services. Therefore, only a small percentage of skiers ever have their cant angle tested or altered. There are numerous reasons for this which will become apparent in the review of prior art.

Ironically, although ramp angle is even more important than canting, even fewer ski shops adjust the ramp angle once the boot is found to be acceptably comfortable by the skier. While ramp angle is dependent on the ramp angle defined by the boot, it is more dependent on the angle defined by a particular ski binding toe and heel height. Manufacturers do not specify to the ski shop or to the skier the relative heights of the toe and heel on a binding. This difference can vary in current binding models from one binding model to another by over ten millimeters.

DESCRIPTION OF PRIOR ART

Various prior art exists for altering the height of the heel portion of the boot over the toe portion of the boot to adjust the ramp angle.

One traditional way of increasing the heel height is to attach a plate to the ski between the upper surface of the ski and the ski binding positioned beneath the heel portion of the ski boot. Another traditional method of changing the ramp angle is to put a lift inside the heel of the boot as described above in *The Athletic Skier* at page 43.

Another well-known method for altering the cant and/or ramp angle is to permanently grind or plane the bottom toe and heel sole portions of the boot.

Another approach to canting is to utilize a ski boot with an adjustable sole that can pivot along a longitudinal axis as depicted in U.S. Pat. No. 5,615,901.

Each of the above listed approaches suffers from a number of disadvantages:

(a) While the traditional method of installing a plate can be effective for altering a skier's ramp angle on some ski-binding systems, even then it requires a time intensive process of custom mounting or remounting the binding on each pair of the customer's skis. In most cases, a technician must first cut and drill the appropriate ramp shim material to match the shape and screw hole pattern of the particular binding being used. Next, the technician must carefully choose longer length screws to install the binding with the cants to meet International Standard ISO 8364 for screw depth and binding retention forces. If the screws chosen are even a little too long, an expensive ski can easily be ruined. If screws are too short, the binding can pull out leading to potential skier injury. Because screw head shapes are often specific to particular binding brands and models, screws must be stocked in a multitude of styles and various lengths.

(b) The above procedure also creates a specific left and right ski due to the angular orientation of the cant shims installed. This prevents a skier from reversing his left and right skis out on the hill which is desirable as edges become dull or damaged, especially for performance minded skiers like instructors, patrollers and racers.

(c) There are also integrated ski-binding systems. On many of these systems, the binding is not attached to the ski with screws, but by various other means such as sliding the binding onto rails or tracks integrated into the ski construction. In these cases, the traditional method of installing cant and/or ramp shims is not possible.

(d) An increasing percentage of skiers choose to rent skis or at least "demo" various models before they buy. Due to the time requirement and cost of installing ramp shims, customizing such rentals is simply not practical. Yet proper ramping and/or canting can make the difference between a skier having a great skiing experience and never wanting to ski again.

(e) Due to the above problems and limitations on installing ramp shims and cants, some ski shops and skiers prefer to permanently grind or plane the bottom toe and heel sole portions of the boot. This method is known as "sole planing". Unfortunately, sole planing is often an imprecise operation that requires the use of dangerous machinery by ski shop employees. Because it is irreversible, a slight mistake can ruin an expensive pair of boots. It also requires that the boot toe and heel sole portions be built back up to meet International Standard ISO 5355 for boot sole thickness and shape dimensions. Since few ski-binding systems supplied by the manufacturer actually have the same ramp angle and, since two systems could vary by more than a centimeter, sole planing is not a practical solution to the ramping problem.

(g) The installation of a lift or orthotic inside the ski boot also has the disadvantage of altering the fit of the ski boot and making precise measurement of the height of the heel over the toe impossible.

OBJECTS AND ADVANTAGES

Accordingly, a need exists for a simple balancing solution to overcome all of the above problems of the prior art. Several objects and advantages of the present invention are:

(a) to provide an apparatus and method for ramping and/or canting a skier that is fast and efficient and that does not require the custom mounting or remounting of each pair of skis by a skilled or highly trained technician, or have the potential for damaging the ski, or cause the binding to pull out which could lead to potential injury, or the need to stock a multitude of screw styles in various lengths to meet International ISO Standards;

(b) to provide an apparatus and method for ramping and/or canting a skier that allows the left and right skis and any canting to be reversed or changed out on the hill as desired;

(c) to provide an apparatus and method for ramping and/or canting a skier on integrated ski-binding systems;

(d) to provide an apparatus and method for ramping and/or canting a skier on rental or "demo" skis, both quickly and cost effectively, to enhance the skier's experience and increase the desire to continue in the sport;

(e) to provide an apparatus and method for ramping and/or canting a skier that is accurate and reversible, and that does not require dangerous grinding or planing of the bottom toe and heel sole portions of the boot, nor any building up of these sole portions to meet any International ISO Standards;

(f) to provide an apparatus and method for ramping and/or canting a skier that can be used with any boot and produced cost effectively in cant angle increments finer than 1 degree and ramping adjustments from zero to one mm or more in increments as fine as 0.1 mm; and (g) to provide an apparatus and method for ramping and/or canting a skier that is practical, lightweight, inexpensive and widely available.

Still further objects and advantages are to provide an apparatus and method for ramping and/or canting a skier that has to include only a modification under the heel support portion of a boot or binding, that is designed to induce a ramp and/or cant angle prescribed for a particular skier, that can be designed to be compatible with the majority of bindings and skis on the market, and that can be manufactured cost effectively out of well-known materials, in various colors, and with visible labeling in a desired location to identify the ramp and/or cant angle. Still further objects and advantages will become apparent from a consideration of the ensuing description and drawings.

DETAILED DESCRIPTION OF THE INVENTION

Reference will now be made in detail to various embodiments of the invention. Examples of these embodiments are illustrated in the accompanying drawings. While the invention will be described in conjunction with these embodiments, it will be understood that it is not intended to limit the invention to any embodiment. On the contrary, it is intended to cover alternatives, modifications, and equivalents as may be included within the spirit and scope of the invention as defined by the appended claims. In the following description, numerous specific details are set forth in order to provide a thorough understanding of the various embodiments. However, the present invention may be practiced without some or all of these specific details. In other instances, well known process operations have not been described in detail in order to not unnecessarily obscure the present invention.

The inventor has discovered through analysis of current ski binding function that the heel height on existing bindings can be safely raised and that, surprisingly, most skiers, even inexperienced ones, are sensitive to incremental increases on the order of 0.1 to 0.2 mm, depending on ski binding design. This has allowed the design of a novel system of ramping and/or canting that eliminates all of the problems listed above for actual and proposed ramping and/or canting systems. In the following, various embodiments of an apparatus and method for balancing a skier are described that are extremely effective in adjusting the height of the heel portion of the boot over the toe portion of the boot to adjust the ramp angle and also facilitate the adjustment of the cant angle. Optimizing these angles improves skeletal alignment and allows the skier to ski with the least amount of muscular effort.

Figure 1A:
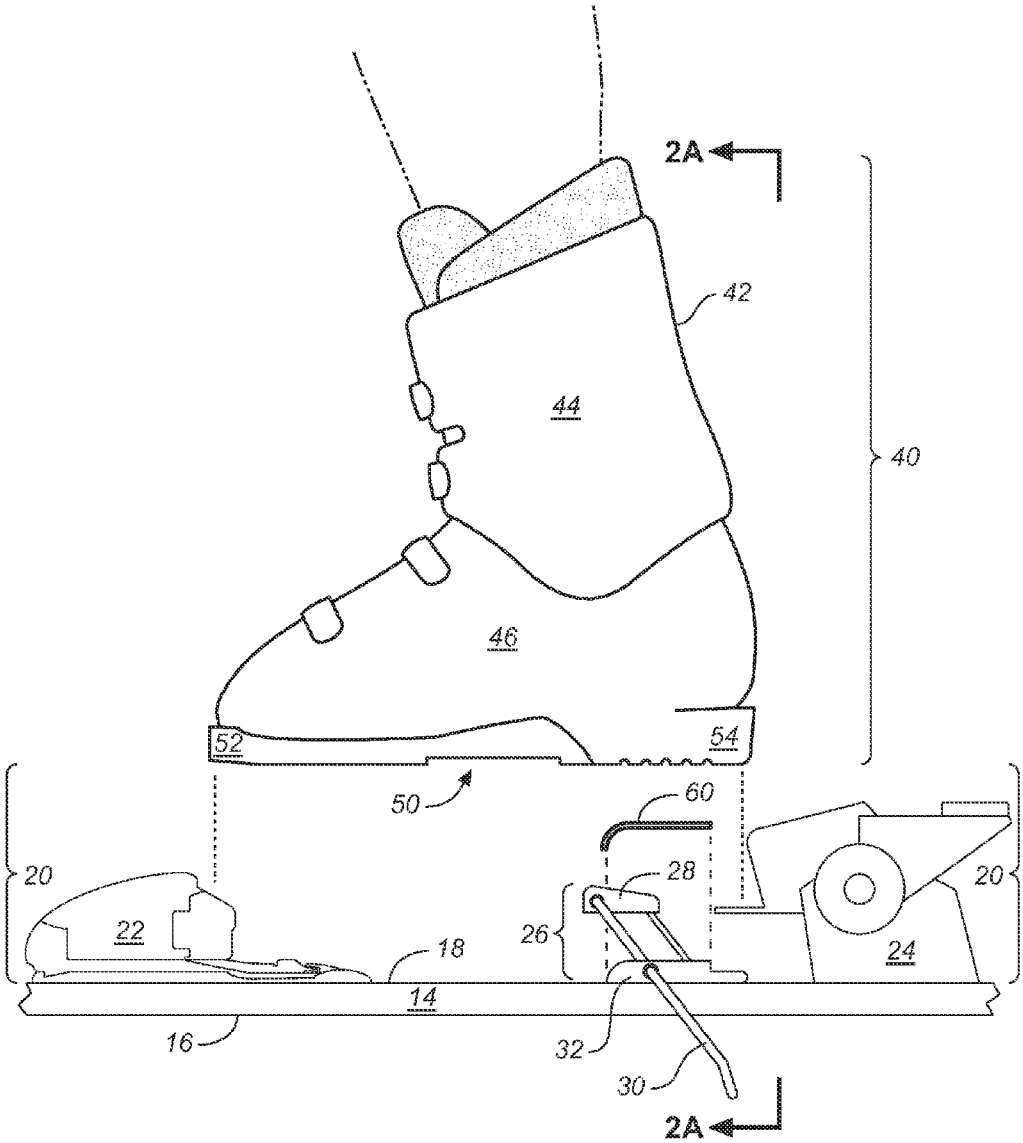
FIGS. 1A-B are side views of an embodiment of the invention integrated into a ski binding system.

Referring now to the drawings where like numerals are used throughout the several views to indicate like or corresponding parts, FIG. 1A is an exploded side view of a standard boot, binding and ski and an embodiment of the present invention where the boot is not retained by the binding. In FIG. 1A, a portion of a ski 14 is depicted having a running surface 16, which contacts the snow when skiing, and an upper surface 18 on which a binding 20 is mounted. Bindings come in many designs; however FIG. 1 depicts generic components which are included in most bindings. A detailed description of the function of the components will be provided below.

The binding 20 includes a toe unit 22, a heel unit 24, and an integrated brake system 26. All ski and binding systems are required by ski areas to include a leash or integrated brake system 26 which usually comprises a brake compressor plate 28, a brake arm 30 on either side of the ski, and a brake heel bearing surface 32.

FIG. 1A also depicts a generic ski boot 40 having an outer shell 42 including an upper cuff 44 for supporting the skier's lower leg and a lower shell 46 for supporting the skier's foot. The boot also includes a sole 50 having a boot toe portion 52 that is engaged by the toe unit 22 of the binding and a boot heel portion 54 that is engaged by the heel unit 24 of the binding.

Different embodiments of a heel mounting plate (HMP) 60 are designed either to mate with a standard heel bearing surface 32, to replace a standard heel bearing surface 32, or to mate with a modified heel bearing surface 32, as described in detail below.

Figure 1B:
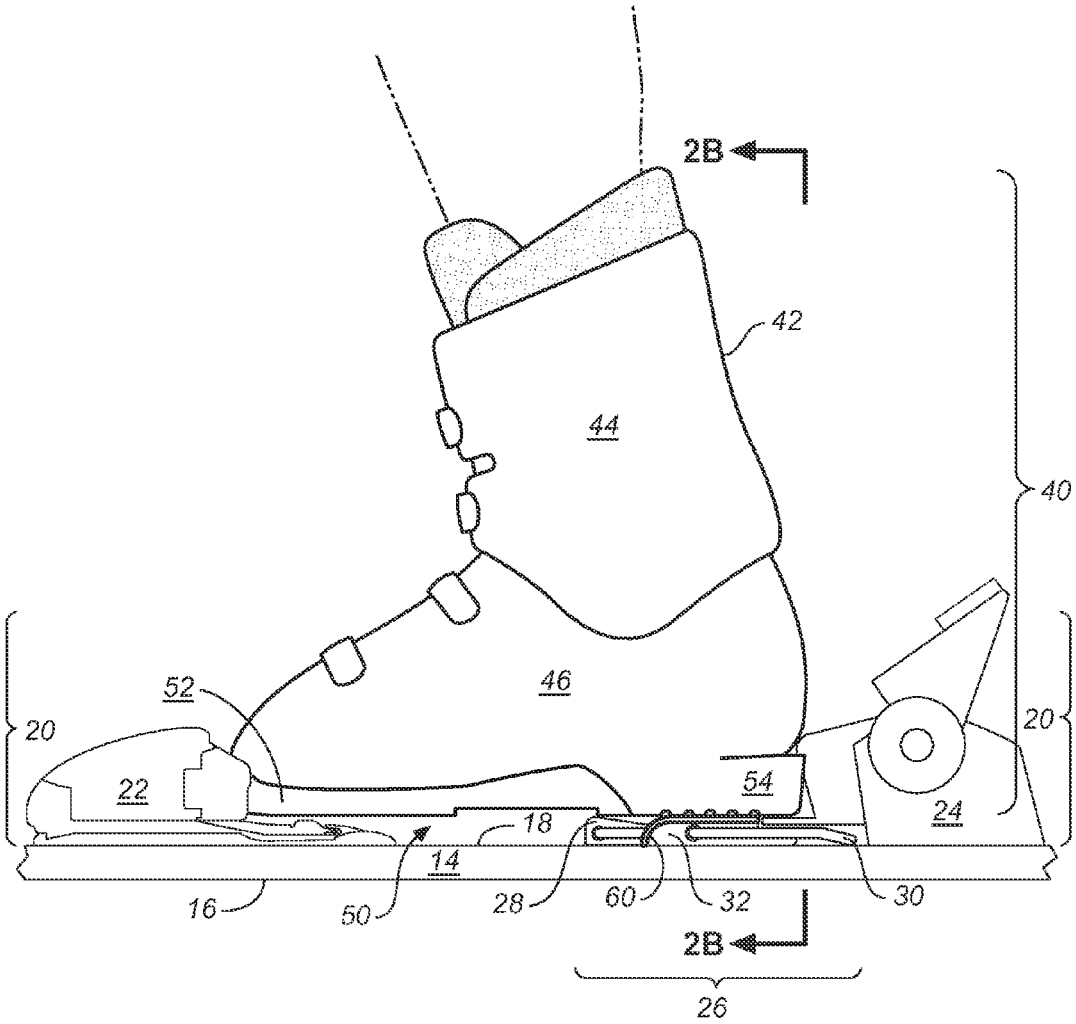

FIG. 1B includes the same components as FIG. 1A and depicts the ski boot 40 retained by the binding 20. The boot toe portion 52 of boot sole 50 is retained by the toe unit 22 of binding 20 and the boot heel portion 54 of boot sole 50 is retained by the heel unit 24 of binding 20. In this embodiment the lower surface of boot heel portion 54 of boot sole 50 does not directly contact the heel bearing surface 32 of integrated brake system 26, but instead rests on the upper surface of HMP 60.

Figure 2A:
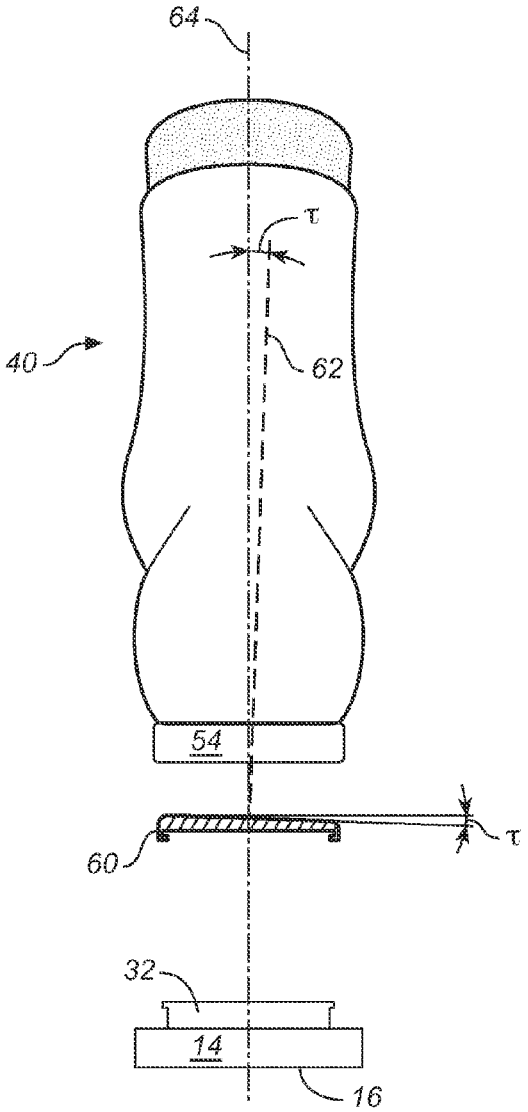
FIGS. 2A-B and 3A-B are simplified rear views showing a cutaway of the embodiment depicted in FIGS. 1A-B.
Figure 2B:
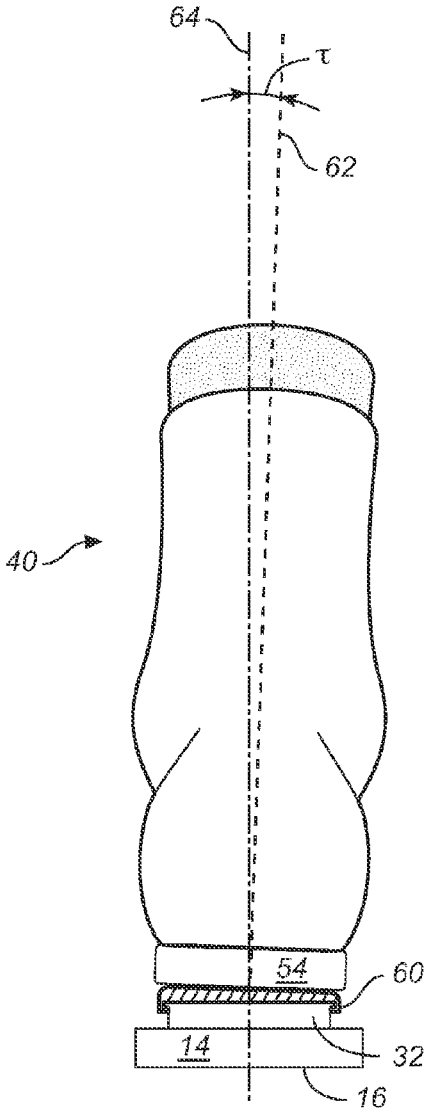

In FIG. 2B the ramp angle is determined by the height in mm of the heel portion above the toe portion. This height can be adjusted by varying the thickness of the HMP 60.

FIGS. 2A and 2B are simplified cut away rear views of ski boot 40, HMP 60, heel bearing surface 32 and ski 14 of FIGS. 1A and 1B respectively, taken along the view lines 2A-2A and 2B-2B. FIGS. 2A-2B depict an example embodiment where the horizontal cross-sectional thickness of the exemplary HMP 60 can be varied to increase the height of the heel portion of ski boot 40 relative to the toe portion thereby increasing the ramp angle.

In this embodiment, the horizontal cross-sectional thickness of the exemplary HMP 60 decreases from left to right to form a planar upper surface having a normal HMP axis 62 tilted at a tilt angle (t) defined as the angle between a normal ski axis 64 perpendicular to the running surface 16 of the ski and the normal HMP axis 62 perpendicular to the planar upper surface of HMP 60. The upper surface of HMP 60 also is oriented at tilt angle $\tau$ from a horizontal line parallel to running surface 16 of the ski.

As depicted in FIG. 2B, the lower surface of boot heel portion 54 rests directly on the upper surface of HMP 60 and is forced down on heel bearing surface 32 by the retention force of heel unit 24 (not shown) so that the heel portion of the ski boot is elevated relative to the toe portion. Also, the entire boot 40 is forced to tilt from normal ski axis 64 by the angle $\tau$. Accordingly, this example embodiment allows for the control of both the ramp angle and cant angle. The ramp angle is determined by the height of the heel portion over the toe portion.

Figure 3A:
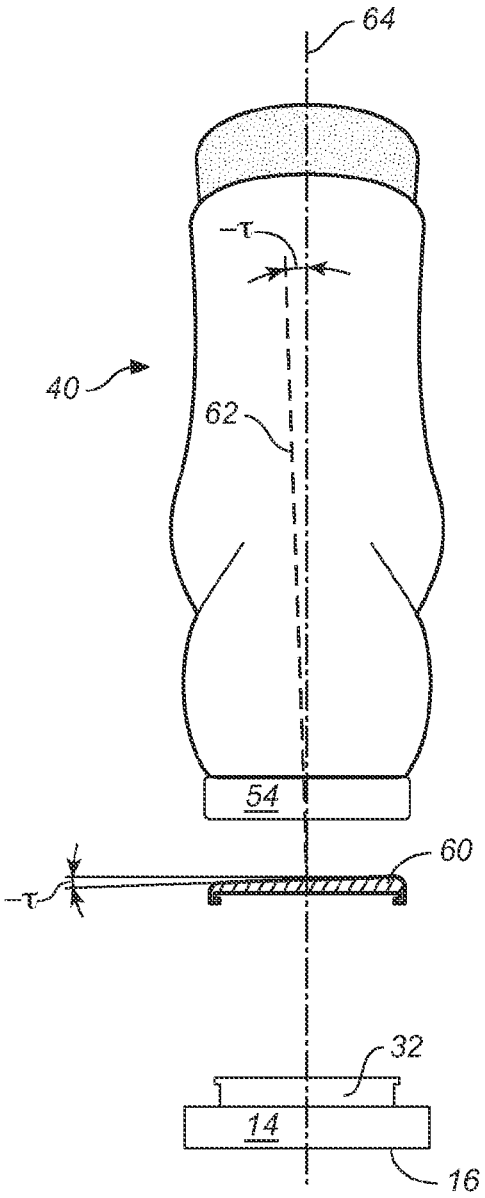
Figure 3B:
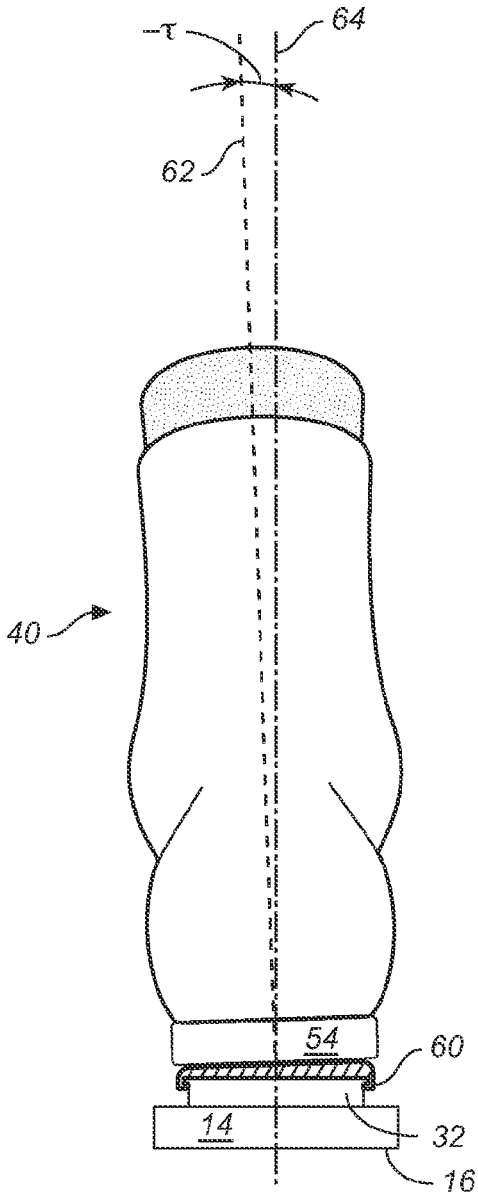

FIGS. 3A-B depict the HMP having a horizontal cross-sectional thickness that decreases from right to left to form a planar upper surface having a normal HMP axis 62 tilted relative to the normal ski axis 64 at an angle of $-\tau$.

FIGS. 4-8 illustrate various embodiments of HMP 60 designed to solve problems posed by different industrial designs of the heel bearing surface included in different brands of bindings. Each view is the same as the view of FIGS. 2A-B but only the heel bearing surface 32 and HMP 60 are depicted.

Figure 4A:
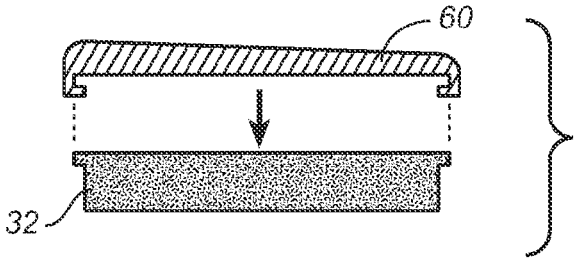
FIGS. 4A-B are cross-sectional views depicting a lock-on embodiment of an HMP (Heel Mating Plate)
Figure 4B:
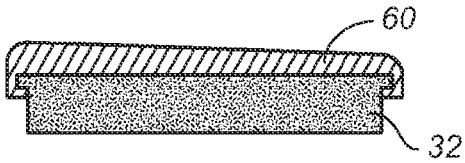

FIGS. 4-6 illustrate "retrofit" techniques that allow the heel bearing surface 32 of an existing commercially available binding to accept an HMP 60. Three different embodiments are depicted.

In FIGS. 4A and B the industrial design of the heel bearing surface 32 is such that its shape allows a lock-on HMP 60 to be designed that will lock onto existing features of heel bearing surface 32. By way of illustration, heel bearing surface 32 depicted in FIG. 4A has protrusions which allow HMP 60 to be designed as a female part that will lock onto these protrusions. It is also necessary that the industrial design of the brake or heel unit allows HMP 60 to be locked onto heel bearing surface 32 without interference from other parts of the binding.

A detailed description of a preferred lock-on embodiment of an HMP, designed for a particular commercial binding, will be described in detail below with reference to FIGS. 9A-H.

Figure 5A:
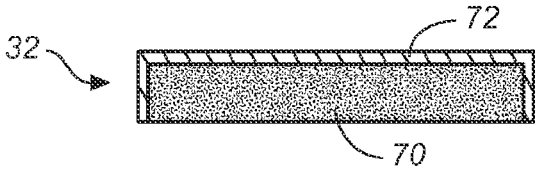
FIGS. 5A-D are cross-sectional views depicting a replacement embodiment of an HMP.
Figure 5B:
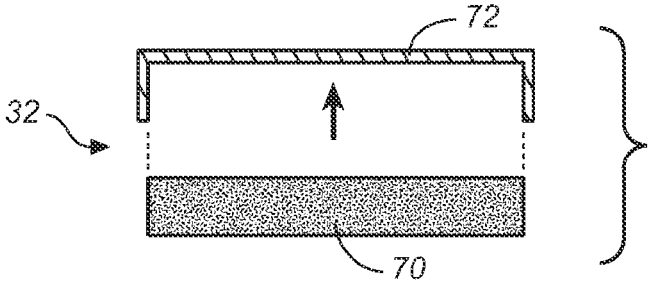

In FIGS. 5A-D the industrial design of the binding does not facilitate the use of the lock-on HMP of FIG. 4. Because other parts interfere, there is no structure to facilitate locking on, or for other reasons. FIG. 5A depicts a heel bearing surface 32 having an interior structure 70 including metal parts, for example, and a removable outer structure 72, which is usually plastic, that has an upper surface on which the heel portion of the ski boot sole rests and which can be easily removed as depicted in FIG. 5B.

Figure 5C:
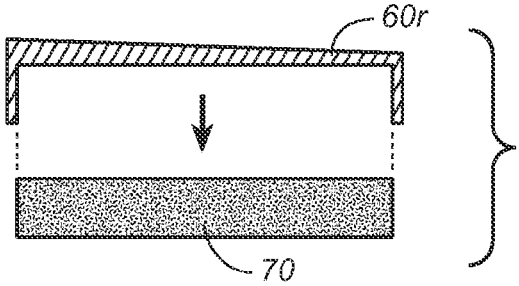
Figure 5D:
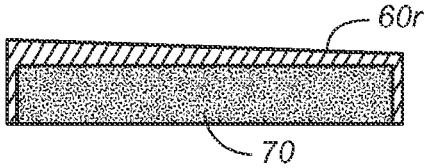

FIGS. 5C-D depict an embodiment of the invention in the form of a replacement HMP 60*r* having an interior portion the same as the removable outer structure 72 so that it may be connected to the interior structure 70. However, the cross sectional thickness of the upper part of replacement HMP 60*r* varies so that the upper planar surface of replacement HMP 60*r* forms an angle of $\tau$ relative to the running surface 16 of the ski (not pictured).

In practice, the removal of the standard outer structure 72 and installation of replacement HMP 60*r* is a simple operation that can be performed quickly by ski shop personnel.

FIGS. 6A-D depict a variation of the embodiment of FIG. 5D that provides an adaptor part 74 to allow the use of an interchangeable lock-on HMP 60. The adaptor part 74 has an interior portion identical to the removable outer structure 72 (FIG. 5A-B) so that it can be connected to the interior structure 70 of the heel bearing surface 32. The outer part of adaptor part 74 includes structure that provides protrusions for a lock-on HMP 60 to lock onto. This embodiment also requires that the industrial design of the brake or heel unit does not interfere with the locking on of lock on HMP 60.

Figure 7A:
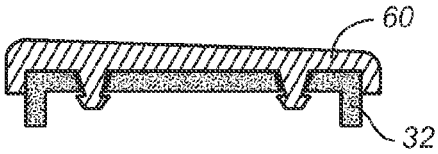
FIGS. 7A-B are cross-sectional views depicting a heel bearing surface having mounting structures that allow connecting an embodiment of an HMP to the heel bearing surface.
Figure 7B:
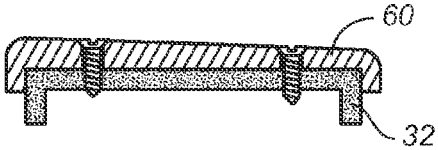

FIGS. 7A-B depict an embodiment for use with a commercially available integrated ski brake or heel unit having a heel bearing surface that does not have a shape that permits locking on and is not easily removable. In this embodiment, the heel bearing surface 32 has been modified by the manufacturer or ski shop personnel to include one or more holes or other mounting structures to facilitate mounting an HMP 60. By way of example, in FIG. 7A the heel bearing surface 32 has holes positioned to receive pins protruding from the lower surface of HMP 60 with each pin having a wider tip which locks into a respective hole. FIG. 7B depicts a heel bearing surface 32 having holes to accept screws or other means for fastening HMP 60 to heel bearing surface 32.

Figure 8:
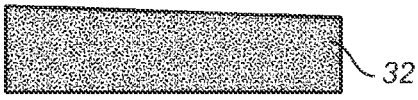
FIG. 8 is a cross-sectional view depicting a replacement brake embodiment of the invention.

FIG. 8 depicts a solution useful where a brake heel bearing surface 32 is not removable, for example where it is molded around the brake arms and the industrial design is such that interference prevents the use of a lock-on HMP. In this example the manufacturer assembles a brake with a heel bearing surface having an upper surface for providing a tilt of a selected angle $\tau$. The brake can be labeled or packaged with an indication of the ramp angle or tilt angle so the skier may select a brake with a desired ramp angle or tilt angle that can be mounted on the binding.

Figure 6A:
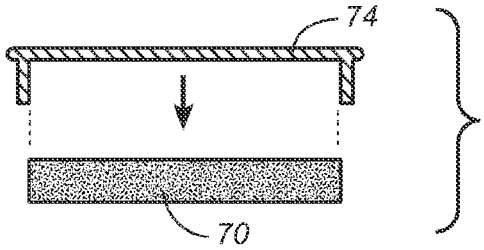
FIGS. 6A-D are cross-sectional views depicting an adaptor piece for receiving a lock on embodiment of an HMP.
Figure 6B:
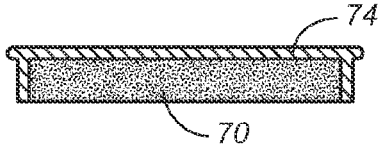
Figure 6C:
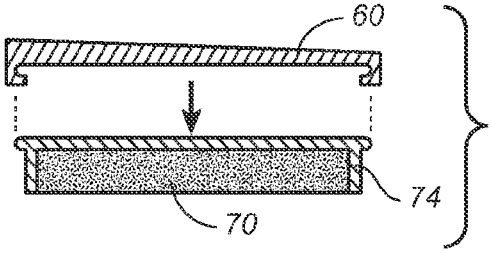
Figure 6D:
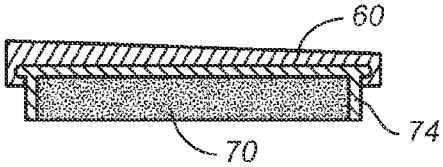

In each embodiment that includes an HMP, an HMP having a $\tau$ of 0° can be utilized initially or in the case where the skier does not require any tilt to be properly canted. For example, manufacturers could ship bindings with a 0° HMP 60 attached to an adaptor part 74 (FIG. 6C).

A preferred thickness can also be provided at any lateral point, for example in the center of each HMP, to create a common point of thickness on variously angled HMPs. When the HMP has a $\tau$ of 0° then the HMP functions to induce only a ramp angle which is determined by this common thickness.

Since many skiers require an increase in heel elevation to achieve the proper ramp angle the HMP with a $\tau$ of 0° solves this function. Furthermore, for all embodiments the thickness of the various parts is designed so that any added step height is within the functional retention range tolerances of the heel unit of the binding. A preferred thickness can also be provided at any lateral point, for example in the center of each HMP, to create a common point of thickness on variously angled HMPs.

FIGS. 9A-9H depict a preferred lock-on embodiment of HMP 60 designed to lock onto structural features that are part of the industrial design of a common ski brake heel bearing surface 32, manufactured by Marker®.

Figure 9A:
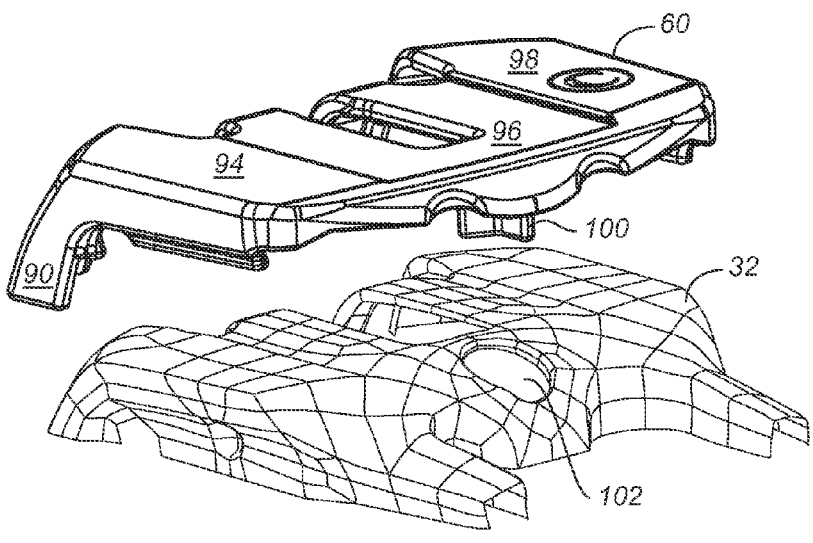
FIGS. 9A-H are detailed views of a preferred lock on embodiment of the invention.
Figure 9B:
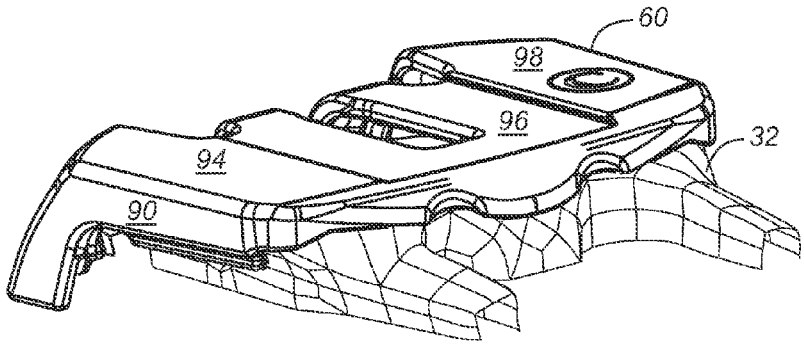
Figure 9C:
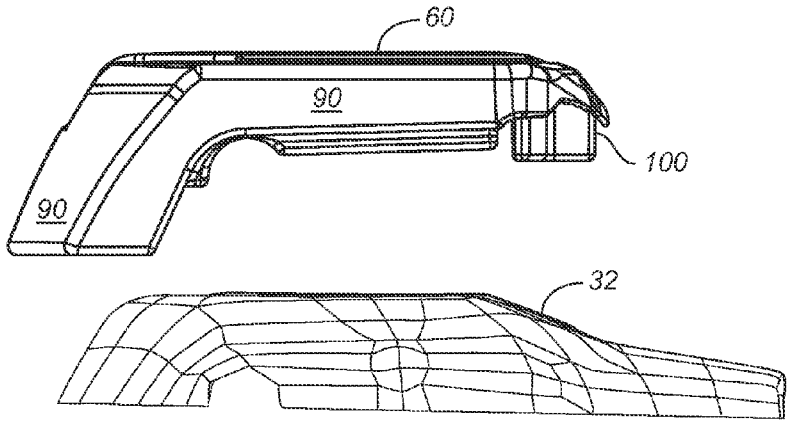
Figure 9D:
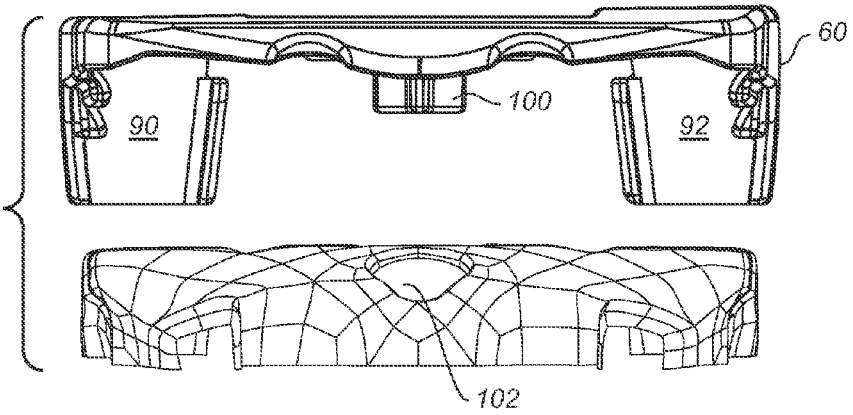

FIGS. 9A and 9B are left rear perspective views of the lock on HMP 60 exploded above and then locked on the Marker® heel bearing surface 32. FIG. 9C is an exploded left side profile view. FIG. 9D is an exploded rear view. In FIGS. 9A-9D, the Marker® heel bearing surface 32 is depicted with contour lines indicating the shape of the surface. Furthermore, lock on HMP 60 includes left and right shrouding parts 90 and 92, left, center and right sections 94, 96 and 98, and an insertion member 100 (depicted in greater detail in FIGS. 9G-9H). The sides of the shrouds 90 and 92 are shaped to fit over complementary shaped sections of the heel bearing surface 32 to effect a secure mechanical lock. The lock is further stabilized by the mating of the insertion piece 100 with an upper opening 102 (seen in FIGS. 9A and 9D) of the Marker® heel bearing surface 32.

Figure 9E:
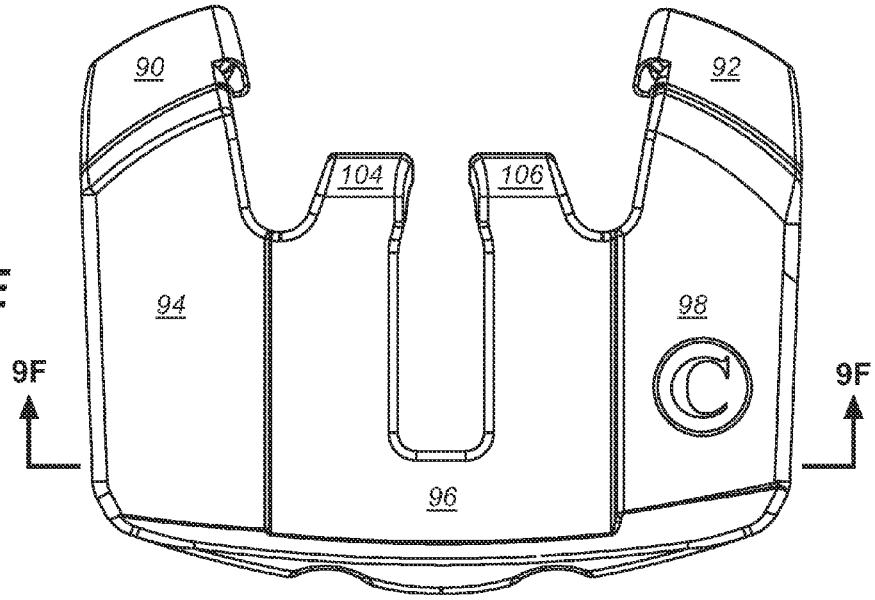
Figure 9F:
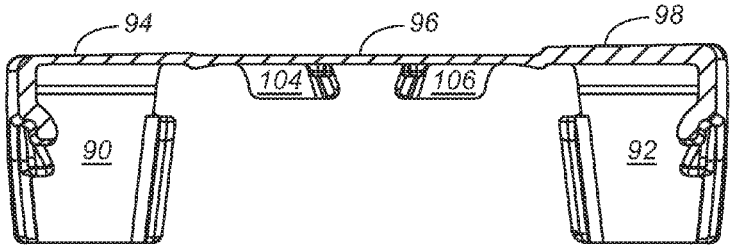
Figure 9G:
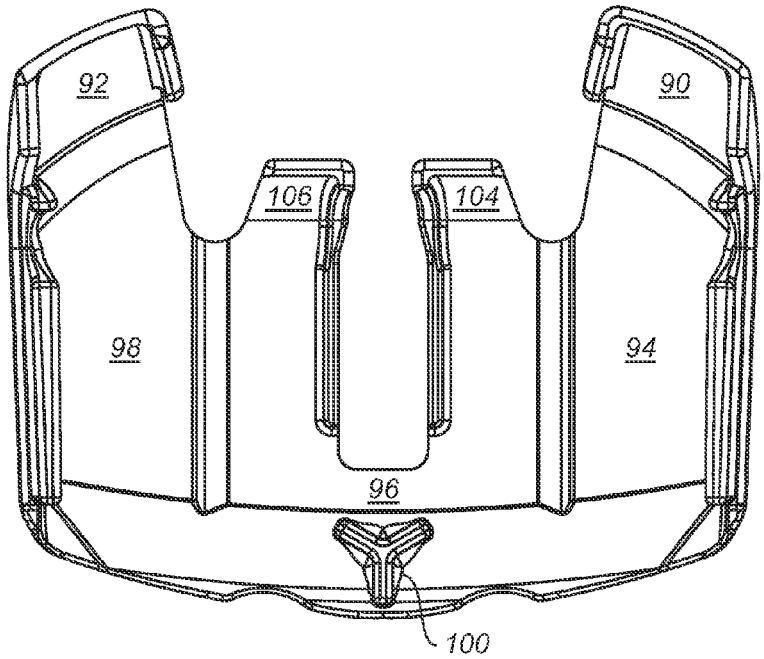
Figure 9H:
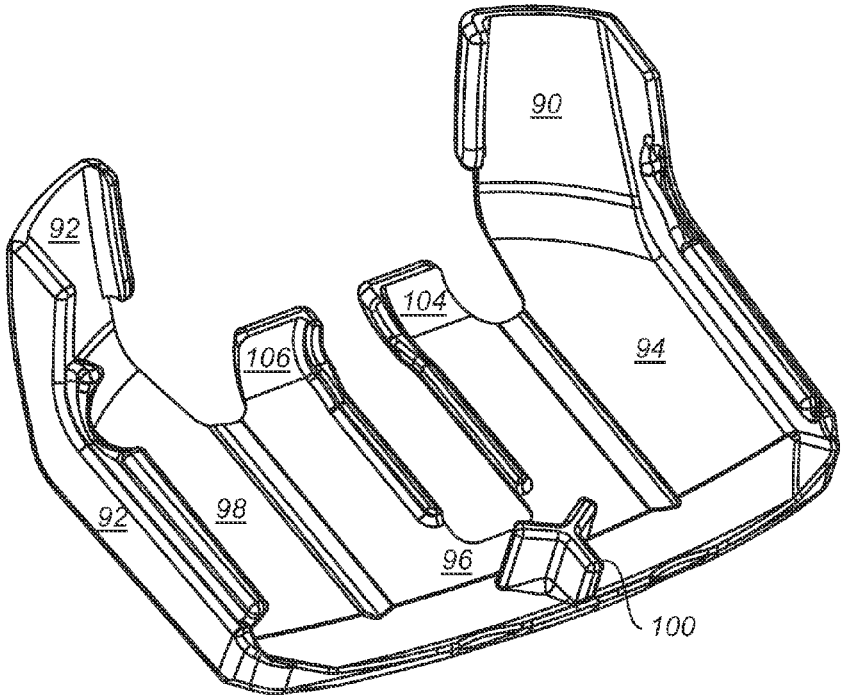

FIG. 9F depicts a cross-section rear view of FIG. 9E along view line 9F of the upper surface of lock-on HMP 60 that induces a tilt of 1° to the left. Note that the upper surface of the center section 96 is lower than the upper tilted surfaces of the right and left sections 94 and 98 so that the boot (not shown) is substantially supported by the upper tilted surfaces of the right and left sections 94 and 98. To create a tilt of 1°, the far right thickness of section 98 is approximately 40/1000 (0.040) of an inch thicker than the far left thickness of section 94. Also, by supporting the boot substantially on these right and left sections, a wobble caused by a slightly higher center section of the common Marker® heel bearing surface 32 is reduced or eliminated. In this case a 0° HMP 60 would be useful to stabilize the skier even if no cant or ramp angle alteration were required.

Additionally, the left and right shrouds 90 and 92 and additional center shrouds 104 and 106 (seen in FIGS. 9E-9H) prevent snow and debris from building up between the lower surface of the lock-on HMP 60 and the Marker® heel bearing surface 32. This is beneficial because debris or snow buildup with a thickness of even 10/1000 (0.010) of an inch lodged between the heel bearing surface and the lower surface of the lock-on HMP 60, for example, could induce an undesirable cant angle change of approximately ¼° or possibly damage the lock-on HMP 60 or induce wobble.

To better understand the operation and effectiveness of the invention, it is helpful to understand basic binding function. Most modern bindings include a toe unit and a heel unit that attach the boot to the ski in two separate places, and that function in different ways to provide effective retention of the boot to the ski for control, and effective release of the boot from the ski in various directions for safety, as in the case of a fall.

The toe unit captures or retains the toe portion of the boot sole for control, and provides primarily lateral release in twisting falls and sometimes vertical release in backward falls. Since twisting falls and backward falls can be quite dangerous, a lower retention force is provided in the toe unit to allow these directions of release. Furthermore, mechanical play or elasticity is purposefully designed into the toe unit. The first reason is to accommodate for allowable boot sole shape tolerances and expected wear. Another reason is to enhance release when needed by minimizing or reducing friction between the boot sole and toe unit. Due to the combined effect of the lower retention force and mechanical play or elasticity, the toe unit does not capture or hold the boot down against the ski, relative to the longitudinal running surface, as aggressively as does the heel unit.

The heel unit captures or retains the heel portion of the boot sole for control, and provides primarily vertical release in forward falls. Due to a skier's forward momentum and the desire to prevent a premature vertical release while skiing, a much higher retention force is designed into the heel unit. Therefore, it is the heel unit of the binding that most securely holds the boot down against the ski, relative to the longitudinal running surface, with the highest degree of retention force. Thus, the strong downward retention force of the heel unit combined with the mechanical play or elasticity of the toe unit provides that a ramp and/or cant angle change at only the heel bearing surface of the binding, with no similar ramp and/or cant angle change at the toe bearing surface, is sufficient to alter the ramp and/or cant angle at which a boot supports a skier's foot and lower leg, relative to the longitudinal running surface or bottom plane of an attached ski.

Conclusion, Ramifications, and Scope

Accordingly, various embodiments of an apparatus and method for ramping and/or canting a skier have now been described which are compatible with existing binding systems, that can be used to modify existing binding systems, or can be manufactured into existing binding systems by binding manufacturers. All of these embodiments provide a fast, accurate, reversible, safe and inexpensive means to alter a skier's ramp and/or cant angle, and can be easily applied by any ski shop personnel or by the skier himself.

While the above description contains much specificity, this should not be construed as limitations on the scope of the invention but as merely providing illustrations of some of the presently preferred embodiments of the invention. Many alternatives and substitutions will now be apparent to persons of skill in the art.

Thus the scope of the invention should be determined by the following appended claims and their legal equivalents, not by the examples given.

What is claimed is:

1. A heel mounting plate configured to rest on and mate with a heel bearing surface of a ski binding having a heel portion and a toe portion, where a heel portion of a boot attached to the ski binding rests on the heel bearing surface of the ski binding, and with the heel bearing surface of the ski binding having features or structure as part of its design, the heel mounting plate comprising:

an upper surface, having one or more sections of variable thickness, configured so that the height along the upper surface is a specified distance above the toe portion of the ski binding when the heel mounting plate is mated with the heel bearing surface;

one or more mating surfaces configured to rest on the heel bearing surface of the ski binding; and one or more complementary mating elements configured to mate with the features or structure of the heel bearing surface of the ski binding, with the mating surface, upper surface and one or more complementary mating elements configured so that the heel mounting plate rests on and mates with the heel bearing surface of the ski binding and does not mate with the toe portion of the ski binding.

2. The heel mounting plate of claim 1 where one or more shrouding parts form one or more shrouds for preventing snow or debris from building up or lodging between the heel bearing surface of the ski binding and the one or more mating surfaces or one or more mating elements of the heel mounting plate.

3. The heel mounting plate of claim 2 where the heel bearing surface of the ski binding includes one or more openings, the heel mounting plate further comprising:

one or more insertion members or pieces, disposed on the heel mounting plate, that mate with the one or more openings of the heel bearing surface of the ski binding when the heel mounting plate rests on the heel bearing surface of the ski binding.

4. The heel mounting plate of claim 1 where the one or more sections of variable thickness of the upper surface are formed and disposed to reduce or eliminate wobble caused by the design or shape of the heel bearing surface of the ski binding.

5. The heel mounting plate of claim 1 further comprising:

one or more visible markings that describe the heel mounting plate such as left or right, ramp angle induced, or thick or thin sections.

* * * * *